United States Patent [19]

Lowe

[11] Patent Number: 4,854,214

[45] Date of Patent: Aug. 8, 1989

[54] ILLUMINATED WIND CHIME

[76] Inventor: Donald J. Lowe, 201 W. Vineyard #183, Oxnard, Calif. 93030

[21] Appl. No.: 242,224

[22] Filed: Sep. 9, 1988

[51] Int. Cl.[4] ..... G10D 13/08

[52] U.S. Cl. ..... 84/404; 84/464 R; 362/253; 362/806

[58] Field of Search ..... 84/402–408, 84/464 R, 464 A; 116/141, 169; 446/421; 362/253, 394, 802, 806

[56] References Cited

U.S. PATENT DOCUMENTS

| | | | |
|---|---|---|---|
| 864,461 | 8/1907 | Gibbs | 116/169 |
| 2,132,297 | 10/1938 | Horowitz | 362/807 X |
| 2,462,750 | 2/1949 | Klein | 362/806 X |
| 2,572,760 | 10/1951 | Rikelman | 362/103 |
| 2,728,258 | 12/1955 | Stegner | 84/464 R |
| 3,016,783 | 1/1962 | Karraker | 84/464 R |
| 3,361,902 | 1/1968 | Cardenas et al. | 362/802 X |
| 3,811,041 | 5/1974 | Matsushita | 84/464 R X |
| 4,097,917 | 6/1978 | McCaslin | 84/464 R X |
| 4,271,457 | 6/1981 | Martin | 362/104 |
| 4,298,917 | 11/1981 | Ware | 362/157 |
| 4,330,771 | 5/1982 | McGovern | 362/806 |
| 4,346,640 | 8/1982 | Zeno et al. | 84/464 R |
| 4,386,550 | 6/1983 | Newsome et al. | 84/464 R |

*Primary Examiner*—L. T. Hix
*Assistant Examiner*—Brian W. Brown
*Attorney, Agent, or Firm*—Harness, Dickey & Pierce

[57] ABSTRACT

A decorative illuminated wind chime apparatus used to produce audio and visual effects from the movement of air currents. The audio effects are accomplished in a conventional manner by the striking of resonant chime tubes by a clapper whose movement is caused by the movement of air. The visual effects are achieved by electrically sensing the collisions of resonant chime tubes with the clapper and illuminating a respective light which is associated with each resonating chime tube. The overall effect is a wind activated audio "chime" which is synchronously accompanied by an associated light display.

8 Claims, 2 Drawing Sheets

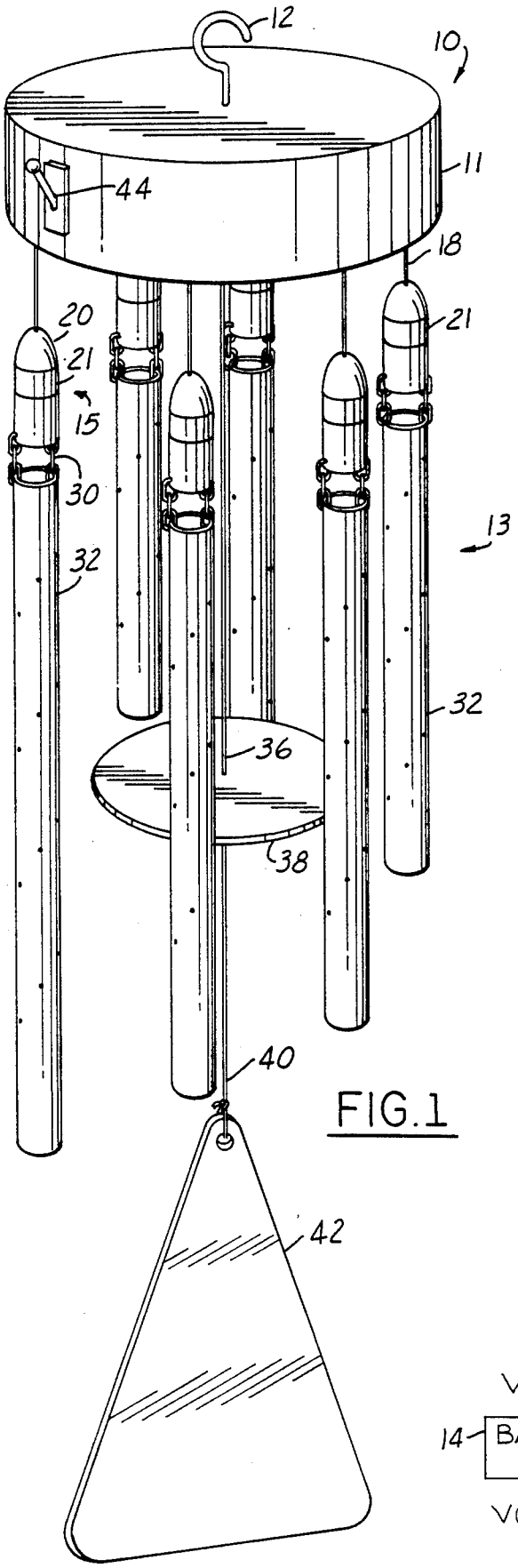
FIG.1
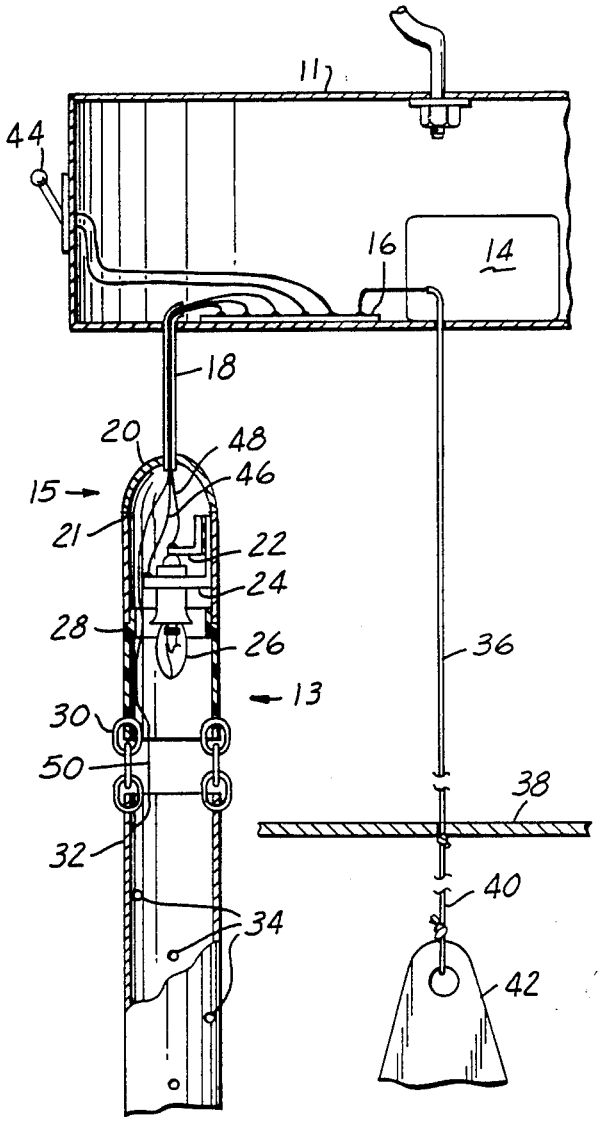
FIG.2
FIG.3
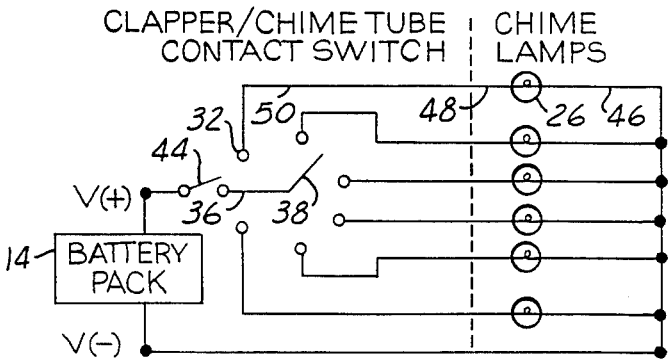

ILLUMINATED WIND CHIME

TECHNICAL FIELD

The present invention relates to wind chimes and deals more specifically with devices which react to ambient air currents to provide musical sounds which are synchronized with an associated visual electric light display.

BACKGROUND OF THE INVENTION

Various devices have been invented which operate to create pleasant sounding musical notes when passed over by a breeze. Such devices are commonly known as wind chimes. Although much enjoyment can be derived from wind chimes, little has been accomplished towards allowing hearing impaired individuals to share that enjoyment through alternative forms of cognitive stimulation. In addition, novel devices have been patented which use physical motion of some type to cause a light or an assortment of lights to flash or illuminate in synchronism to the physical movement. See, for example, U.S. Pat. No. 4,271,457 which discloses jewelry which intermittently lights in response to movement of the wearer. Also see U.S. Pat. No. 4,346,640 for decorative light flashing apparatus which responds to impulse type sounds. In addition, see U.S. Pat. No. 2,572,760 which discloses an illuminated shoe device which flashes a light in synchronism to the wearer's footsteps. None of these above-cited patents, however, use physical movement induced by ambient air currents to produce pleasantly sounding musical notes. In addition, none disclose a decorative apparatus which coordinates the illumination of associated lamps to flash in synchronism with their associated musical note, thereby producing a stimulating show of lights and musical notes triggered by the movement of air.

It is therefore a principal object of the invention to provide a light synchronized musical chime which is activated by the wind A further object of this invention is to provide a portable, decorative illuminated wind chime which allows the hearing impaired to enjoy the visual analog of the sounds of a wind chime.

It is another object of this invention to provide a practical light and sound synchronized wind chime through the use of an electronic sensing circuit which causes each light to illuminate for a duration proportional to its respective chime's resonant time constant.

SUMMARY OF THE INVENTION

In light of the foregoing objects, the present invention provides an illuminated wind chime apparatus which employes several chime elements which are loosely suspended from a common housing such that the chime elements are free to resonate audible sounds when struck. The chime elements are configured such that they will strike each other when moved upon by the wind or they will be struck by a central clapper when the clapper is moved upon by the wind. In addition to the audible sounds produced by the stricken chime elements, associated lights are designed to flash each time a light associated chime element is struck.

These and other aspects, objects, features and advantages of the present invention will be better understood by considering the detailed descriptoin below and the appended claims in conjunction with the drawings.

BRIEF DESCRIPTION OF THE DRAWINGS

FIG. 1 is a perspective view of an embodiment of the invention showing an overhead housing which supports a plurality of chime elements which surround a centrally located chapter.

FIG. 2 is a cutaway drawing particularly showing electronics mounted inside the overhead housing, and a cutaway view of a chime tube assembly.

FIG. 3 shows an electric schematic of the disclosed invention in its simplest form (i.e. without the use of a buffer or timer circuit).

DETAILED DESCRIPTION OF THE PREFERRED EMBODMENTS

Figure 4:
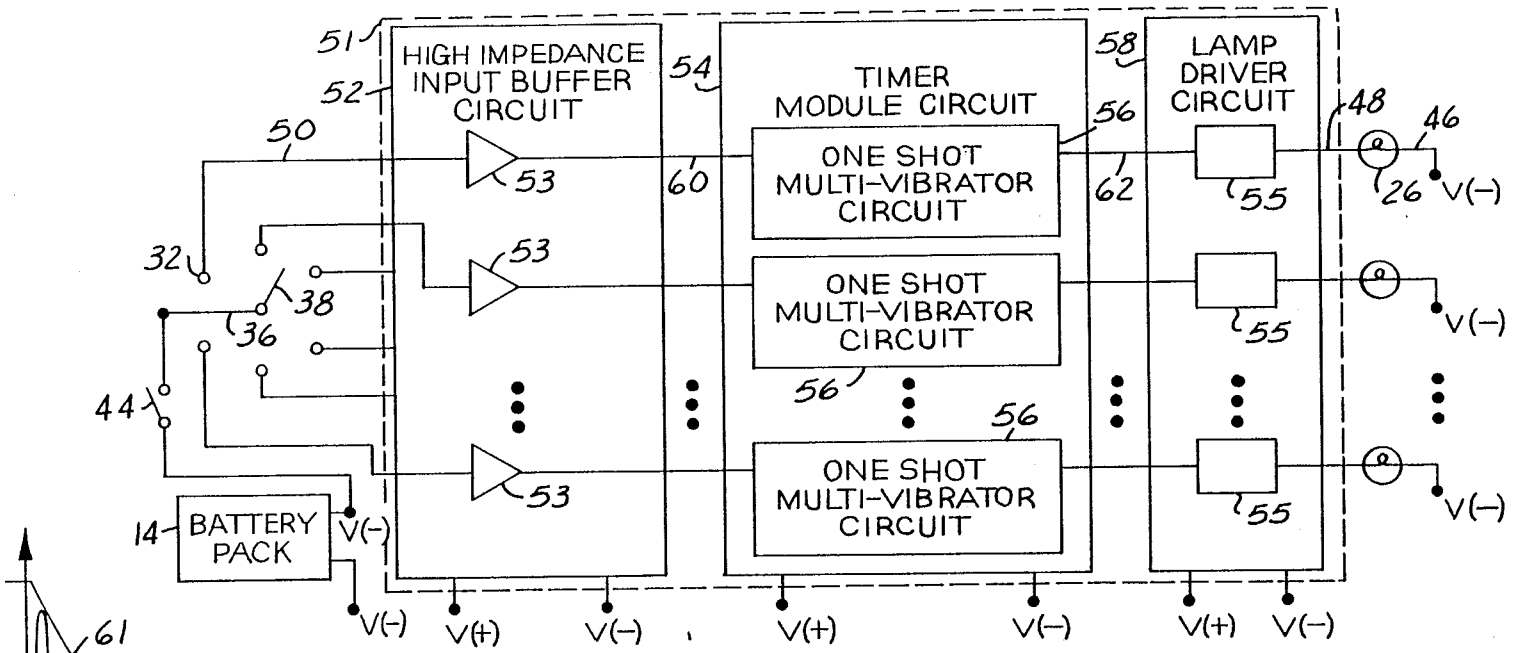
FIG. 4 is a schematic block diagram of the associated electronics used to control the synchronization between the chime tube sounds and their respective lights.

Referring now to FIG. 1 of the drawings, an illuminated wind chime 10 is shown including an overhead housing 11 made of any suitable material such as plastic or tin which is typically suspended from an existing support by using a conventional hanger 12. Extending from the bottom side of the overhead housing 11 are a plurality of chime tube assemblies 13. These chime tube assemblies 13 are secured to the overhead housing 11 by a chime support cord 18. Each chime tube assembly 13 includes an upper support assembly 15, a resonating member or chime tube 32, and an interconnecting support wire or chains 30. The support chains 30 allows the chime tube 32 to freely resonate substantially unaffected by the mass or the rigidity of the upper support assembly 15. The length of the chime tubes 32 may all be made the same if desired, but preferably are made so as to have different lengths as shown so they will each produce a different tone.

In addition to the supporting of the chime tube assemblies 13, the overhead housing 11 also supports the chime clapper 38 which hangs from the overhead housing by way of the electrically conductive clapper support wire 36. A conventional wind deflector 42 hangs from the wind deflector support wire 40 which is supported from the underside of the clapper 38. The wind deflector 42 is designed and oriented so that a large portion of its surface area will oppose slight air current and may be made of any suitable material such as plastic or chromed steel. This opposition force is then transferred to the clapper 38 which causes it to swing in a pendulum fashion and strike the surrounding chime tubes 32 causing them to resonate in a rather random fashion. It is to be understood that the use of a clapper 38 and wind deflector 42 is not the only way to induce chime tube resonance. One such other method includes arranging the chime tubes 32 such that they themselves move against each other when passed over by the wind.

Referring now to FIG. 2, as previously discussed, each time a chime tube 32 is struck, an associated chime lamp 26 glows for a certain period of time thereby snychronizing associated chime tube resonance to chime lamp 26 illumination. The chime tube 32-chime lamp 26 synchronization is accomplished as follows. Clapper suport wire 36 supplies an electric charge to the clapper 38. When the wind blows sufficiently, the clapper 38 will strike against a chime tube 32. When this striking occurs, electrical contact is made between the clapper 38 and the chime tube 32, and an electric current flows therebetween and along the respective clapper sense wire 50. The clapper 38 and the chime tube 32 are constructed with electrically conductive material such as sheet steel so that they serve as a pathway for electric current when they contact each other.

FIG. 3 shows one embodiment of the electrical sensing circuit used to synchronize the chime lamp illumination with the associated chime lamp. The embodiment shown in FIG. 3 is the simplest and most inexpensive way to accomplish synchronization. The circuit of FIG. 3 operates as follows. The clapper support wire 36 is electrically connected to the V(+) side of the battery pack 14. The clapper 38 is electrically connected to the clapper support wire 36 and therefore assumes a V(+) potential voltage. When a wind of sufficient intensity blows, the clapper 38 will strike a chime tube 32, thereby causing the chime tube 32 to resonate at its natural resonant frequency. The clapper 38-chime tube 32 contact also creates a momentary current path, thereby causing the chime tube's 32 associated chime lamp 26 to glow. An on-off switch 44 is provided to prevent battery pack drain when the illuminated wind chime 10 is not in use. In an alternative embodiment, the voltage source, instead of being from a battery pack 14, could be provided by a standard A.C. to D.C. converter which converts a normal A.C. power source (e.g., 120 V.A.C.) to a suitable low-level D.C. (or even A.C.) voltage. Additionally, the type of lamp 26 used or the voltage it operates at is not critical provided it is compatible with the supplied voltage.

The physical construction of the typical chime tube assembly 13 is detailed in FIG. 2. Chime support cord 18 provides two distinct functions. First, it supports the chime tube assembly 13, and second it acts as a conduit for electrical conductors V(−) 46, lamp power 48, and the clapper sense 50. The upper support assembly 15 includes a chime support dome 20, an upper support ringe 21 and a translucent ring 28 all constructed from translucent material such as tinted glass or colored plastic. Use of translucent materials in these locations will act to disperse the light as emitted from lamp 26 and thereby give each chime tube assembly 13 a greater illumination and the desired decorative lighting effect each time it resonates. The upper support ring 21 is constructed from any suitable material such as metal or plastic. Attached to the upper support ring 21, is a lamp socket 22 supported by a lamp support fixture 24. A chime lamp 26 is centrally supported and positioned by lamp socket 22 so that its emitted light passes through the translucent ring 28 and chime lamp support dome 20. Lamp socket 22 also provides for the proper electrical connection between the chime lamp 26 and the V(−) 46 and lamp power 48 conductors. The chime support dome 20, colored translucent ring 28, and the refraction holes 34 all act to diffuse the light emitted from the chime lamp 26. The V(−) 46 conductor, and the lamp power 48 conductor provide the current path for illuminating the chime lamp 26.

FIG. 4 shows a detailed block diagram of an electronic sensing circuit 51 of the illuminated wind chime 10. The chapter 38 chime tube 32 contact switch operates precisely as previously explained. However, instead of using the clapper 38, chime tube 32 contact to directly switch the chime lamp 26 current on and off, the preferred electronic sensing circuit 51 shown in FIG. 4 uses an electronic sensing circuit 51 to produce a more reliably controlled lighting effect. The electronic sensing circuit 51 is composed of a input buffer circuit 52, timer module circuit 54, and lamp driver circuit 58 interconnected as shown. Input buffer circuit 52 includes a plurality of high impedance signal conditioners 53, one for each chime tube 32. The components used to construct the high impedance signal conditioner 53 are not critical and standard logic gates, analog amplifiers, or discrete components may be use. The input impedance of the input buffer circuit 53 should be within the range of .5 kilo-ohms to 10 mega-ohms with 25 kilo-ohms to 250 kilo-ohms being preferred. The timer module circuit 54 includes a plurality of standard one-shot multivibrator circuits 56. The lamp driver circuit 58 is comprised of a plurality of lamp drivers 55, one for each lamp 26. There is no need to elaborate on the detailed construction of the elctronic sensing circuit 51 because all of the circuits used therein are found in many basic electronics text books and engineering application handbooks.

The circuit 51 of FIG. 4 works as follows. Clapper 38-chime tube 32 contact is sensed by the input buffer circuit 52 whenever current flows along a clapper sense wire 50. The clapper sense wire 50 is attached to chime tube 32 by any suitable means such as wire bonding or soldering. Clapper sense wire 50 in constructed from small strands of thin wire or any other conventional construction whereby its presence will not substantially interfere with chime tube 32 when it resonates. The nature of the high input impedance circuit substantially reduces the dependence the electronic sensing circuit would otherwise have on the ohmic quality of the clapper 38-chime tube 32 connection. As the surface of the chime tube 32 and clapper 38 oxidize or otherwise become contaminated (by weather, aging, etc.), they may not function as good electrical conductors, and, consequently, without the use of a high impedance buffer circuit the lamp illumination would likely not faithfully track the sound produced from the resonating chimes. However, since the high impedance buffer circuit 52 is extremely sensitive to small currents, it will nevertheless detect when the clapper 38 has struck a chime tube 32 even if high resistance is present in the circuit. The output of the high impedance buffer circuit 60 is connected to the input of a one-shot multi-vibrator circuit 56.

Figure 5:
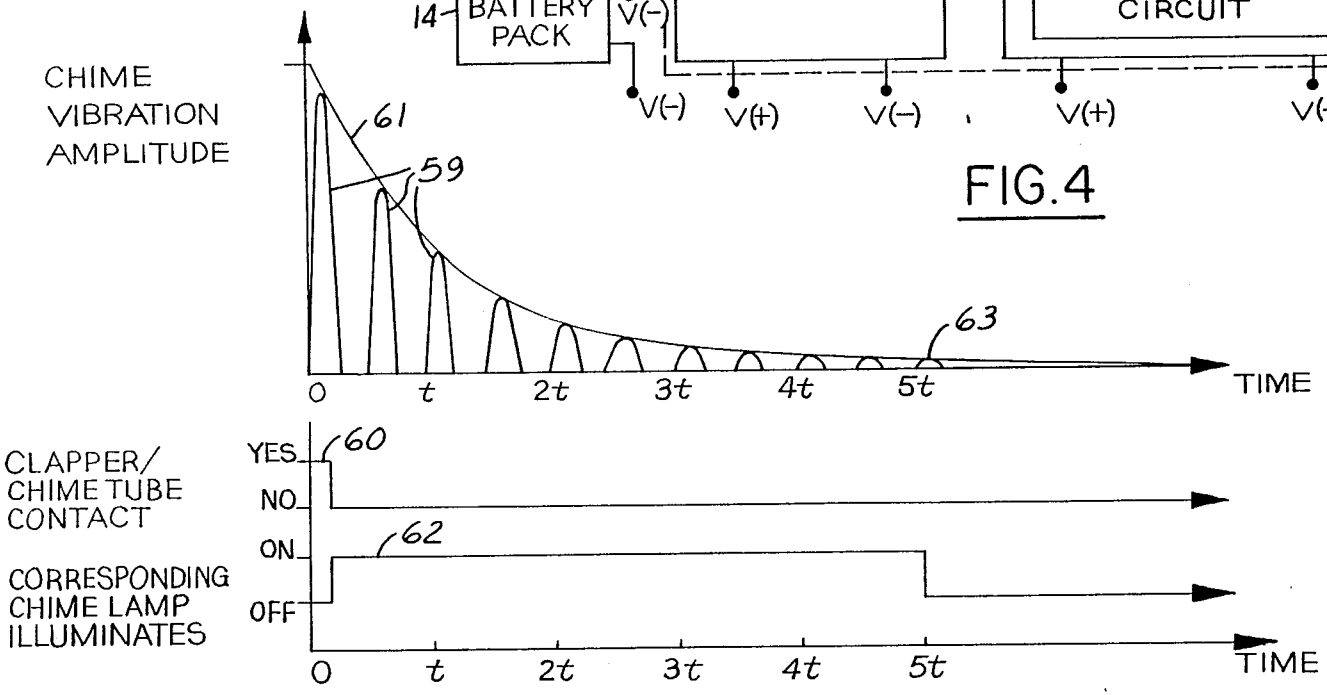
FIG. 5 shows the relation between the exponential resonant decay of a typical chime element oscillation and the duration over which the respective light will be illuminated.

FIG. 5 shows how a typical one-shot multi-vibrator 56 operates to control the duration over which the chime lamp 26 will remain illuminated. Referring now to FIG. 4 and FIG. 5, when the clapper 38 strikes a chime tube 32, two events occur. Firstly, the struck chime tube 32 begins to vibrate as is represented by oscillations 59, and secondly an electrical pulse 60 is sent to the timer module circuit 54. The decay of the chime vibration amplitude represented by envelope or curve 61 is normally exponential in nature and accordingly no appreciable audible sound remains after five times constants have transpired, i.e., at location 63 on curve 61. So that each chime light 26 faithfully tracks the sound made by its respective chime tube 32, a conventional one-shot multi-vibrator circuit 56 is turned on when its associated chime tube 32 is struck, as shown at location 60 on the middle graph of FIG. 5, and turned off when its respective chime tube 32 ceases to resonate as shown at location 63. When the one-shot multi-vibrator 56 receives the triggering signal 60, its output on conductor 62 signals the lamp driver circuit 58 and the respective chime lamp 26 begins to glow. When the one-shot multi-vibrator 56 times out, output 62 turns off, thus turning off the lamp driver circuit 58, and the respective chime lamp 26 is extinguished. The duration necessary for the chime vibration amplitude to decay five time constants is a function of the materials used in constructing the chime tubes 32 as well as the intensity of the striking force used to initiate the chime tube resonance. Although the duration over which each chime lamp 26 remains illuminated may be made as long as five time constants (or longer), a duration in the range of one to three times constants is believed to give a faithful visual analog of the audio sounds which emanate from the chime tubes 32, and is therefore preferred.

The foregoing detailed description shows that the preferred embodiments of the present invention are well-suited to fulfill the objects above stated. It is recognized that those skilled in the art may make various modifications or additions to the preferred embodiments chosen to illustrate the present invention without departing from the spirit and proper scope of the present invention. Accordingly, it is to be understood that the protection sought and to be afforded hereby should be deemed to extend to the subject matter defined by the appended claims, including all fair equivalents thereof.

I claim:

1. An illuminated wind chime apparatus, comprising:

a plurality of resonating members for producing audible sound;

means for loosely supporting said resonating members spaced from one another such that each said resonating member is free to resonate when struck;

means for randomly striking said resonating members when said wind chime apparatus is introduced into a wind current;

a plurality of lights, each said light associated with a respective one of said resonating members; and means for illuminating each said light when its respective resonating member is struck.

2. An illuminated wind chime apparatus as set forth in claim 1, wherein each of said resonating members includes a hollow rigid elongated tube.

3. An illuminated wind chime, comprising:

a housing;

a plurality of chime tubes assemblies flexibly attached to said housing and freely hanging therefrom, each said chime tube assembly including a chime tube and a light socket;

means for randomly striking said chime tubes when wind blows, thereby causing said chime tubes to resonate audible sounds;

a plurality of lights, one said light mounted within each said light socket; and means for illuminating each said light whenever its respective chime tube is struck by said means for randomly striking.

4. An illuminated wind chime apparatus as set forth in claim 3, wherein said striking means includes a clapper, flexibly attached to said housing and freely hanging therefrom, adapted to randomly swing and collide with said chime tubes when said clapper is introduced into wind currents, thereby causing said chime tubes to resonate audible sounds.

5. An illuminated wind chime apparatus, comprising:

a housing;

a plurality of chime tube assemblies flexibly attached to said housing and hanging therefrom in a generally circular arrangement, said chime tube assemblies including an upper support assembly and a chime tube loosely attached to said upper support assembly;

a clapper flexibly attached to said housing and hanging therefrom such that when introduced into a wind current, said clapper swings and randomly collides with said chime tubes, thereby causing said chime tubes to resonate audible sounds;

a plurality of lamps, one said lamp associated with and fixed within each said chime tube upper support assembly; and an electronic sensing circuit which senes contact between said clapper and each of said chime tubes and upon sensing such contact causes the lamp associated with the respective chime tube with which such contact has been made to illuminate for a fixed period of time.

6. An illuminated wind chime apparatus as set forth in claim 5, wherein said electronic sensing circuit includes:

a high impedance input buffer circuit means for generating an electronic signal for each sensed contact between said clapper and each of said chime tubes, said buffer circuit means functioning to substantially reduce any depenence said electronic signals have on the integrity of the contact beween the clapper and the chime tubes;

timer circuit means connected to said high impedance buffer means for producing timing signals representing the duration over which each of said associated chime lamps are to be illuminated in response to sensed contact between the clapper and the chime tubes; and lamp driver circuit means interconnecting said timer circuit means to said associated lamps for applying ample current to each of said lamps for the duration determined for that lamp by said timer circuit means.

7. An illuminated wind chime apparatus as set forth in claim 6, wherein said buffer circuit means provides an electrical charge potential on said clapper and a different charge potential on said chime tubes, and senses the charge flow through each said chime tube.

8. An illuminated wind chime apparatus as set forth in claim 6, wherein each of said chime tubes have a characteristic resonant time constant and each said timer circuit timing signal has a duration which causes said respective chime lamps to illuminate for a period of one to five time constants of said associated chime tube.

* * * * *

UNITED STATES PATENT AND TRADEMARK OFFICE

CERTIFICATE OF CORRECTION

PATENT NO. : 4,854,214

DATED : August 8, 1989

INVENTOR(S) : Donald J. Lowe

It is certified that error appears in the above-identified patent and that said Letters Patent is hereby corrected as shown below:

Column 2, line 6, delete "chapter" and insert -- clapper --.

Column 4, line 9, delete "use" and insert -- used --.

Column 6, line 21, delete "senes" and insert -- senses --.

Column 6, line 33, delete "depenence" and insert -- dependence ----.

Column 6, line 34, delete "beween" and insert -- between ----.

Signed and Sealed this

Seventh Day of September, 1993

Bruce Lehman

*Attest:*

BRUCE LEHMAN

*Attesting Officer*

*Commissioner of Patents and Trademarks*